United States Patent [19]

Vallis

[11] Patent Number: 4,813,404

[45] Date of Patent: Mar. 21, 1989

[54] LOTION AND CREAM APPLICATOR, AND BODY ROLLER AND MASSAGER

[76] Inventor: Joseph Vallis, Apt. #3209, 44 Charles St. W., Toronto, Ontario, Canada, M4Y 1R8

[21] Appl. No.: 911,807

[22] Filed: Sep. 26, 1986

[30] Foreign Application Priority Data

Feb. 12, 1986 [CA] Canada ..... 501692

[51] Int. Cl.[4] ..... A61H 15/00

[52] U.S. Cl. ..... 128/57

[58] Field of Search ..... 401/28; 128/57, 58, 128/62 R, 67

[56] References Cited

U.S. PATENT DOCUMENTS

| | | | |
|---|---|---|---|
| 718,170 | 5/1901 | Sullivan | 128/57 |
| 2,599,367 | 6/1952 | Brucato | 128/57 |
| 2,765,786 | 10/1956 | Blong | 128/57 X |
| 2,767,707 | 10/1956 | Toivonen | 128/57 |
| 3,542,016 | 11/1970 | Zimmer . | |
| 3,672,358 | 6/1972 | Majewski | 128/57 |
| 3,756,224 | 9/1973 | Laymon | 128/57 |
| 4,128,350 | 12/1978 | Gamache . | |
| 4,167,940 | 9/1979 | Ruf | 128/57 |
| 4,267,610 | 5/1981 | Blakeway | 128/57 |
| 4,483,356 | 11/1984 | Kales . | |

FOREIGN PATENT DOCUMENTS

| | | | |
|---|---|---|---|
| 880289 | 10/1961 | United Kingdom | 128/57 |

*Primary Examiner*—Richard J. Apley
*Assistant Examiner*—J. Welsh
*Attorney, Agent, or Firm*—Donald E. Hewson

[57] ABSTRACT

An applicator implement for massaging the body and for spreading lotion or cream over portions of the body is disclosed. The applicator has at least one axle, usually four, and on the one or each axle there are mounted a plurality of wheel components that are rotatable independently one of another. Each wheel component is formed of a soft and pliable material so as to be resilient when pressed against the body, and comprises at least five major faces around its periphery—usually six—where each major face is gently concavely curved and the transition between adjacent major faces is more prominently convexly curved. Each of the wheel components is of substantially constant thickness from side to side, at least at the periphery thereof.

8 Claims, 2 Drawing Sheets

LOTION AND CREAM APPLICATOR, AND BODY ROLLER AND MASSAGER

FIELD OF THE INVENTION

This invention relates to an applicator implement for massaging the body and for spreading lotion or cream over the body. More particularly, the present invention relates to an applicator implement having at least one series of wheels mounted for independent rotation one of another on an axle, where the wheels have a configuration that lends itself to spreading cream on the body, and also where the wheels are relatively soft and pliable so as to be resilient when pressed against the body.

BACKGROUND OF THE INVENTION

There are several ways of spreading creams or lotions over the body, and of massaging portions of the body, in such a way that there is substantially constant contact by the implement doing the spreading or massaging with the skin. The most obvious, of course, is simply to use the hand to spread a cream or lotion over portions of the body; otherwise, various manufactured implements can be used.

There are various kinds of lotions or creams that are intended to be spread over various parts of the body. There are facial ointments of varying kinds to be applied to the face and neck tissues; body lotions for skin toning, moisturising or as skin colorants; tanning lotions and sun shielding creams and lotions; depilatory lotions and creams; and more recently reducing creams and lotions such as those which are particularly intended to reduce cellulite or water retention in body tissue. Many such implements are, of course, sold over the cosmetic counters, and it is to that channel of trade that the present invention is directed.

At the same time as a woman (usually) is applying a lotion such as a body lotion or a reducing cream, she may wish to massage the skin and body tissue where the cream or lotion is being applied. To use the hand may be unacceptable—especially if there is some skin reaction to take place—and in any event requires thorough washing and rinsing of the hand after the application process has been completed. Moreover, use of the hand does not necessarily provide the massaging stimulus that is required, if not for other reasons than simply that it is sometimes difficult to apply or use the strength of the fingers in an effectual manner. On the other hand, use of implements such as ball-type rollers of the kind used principally for applying deodorants or antiperspirants, is not acceptable because the area being contacted is too small and because the ball must continue to be lubricated by the lotion from within a dispenser. Often, it is at least desirable to initially spread or dispense he lotion from a squeeze dispenser, or possibly using a tissue or the like; especially if the cream or lotion is one which is sold at a premium or higher price, and does not lend itself to being sold in a self-dispensing container in the same manner as deodorants.

The present invention provides an apparatus or implement for spreading lotion or cream over portions of the body, while at the same time permitting a massaging action of the body tissue over which the implement is moved. This invention recognizes that the best effect as to massaging is accomplished by having a number of independently moving contacting surfaces against the skin, where the material which those contacting surfaces defines may itself be somewhat resilient or pliable so as to permit greater or lesser pressure against the skin surface—and so as to accommodate slight irregularities in the skin and tissue surface such as when being moved over a cellulite deposit or over portions of the body where bone structure may be close to the surface such as ribs, backbone, shoulder blades, pelvis, cheek bones or jaw and chin structure. This is achieved by the provision of a plurality of wheel components which are independently mounted one of the other on at least one axle, and which are rotatable independently one of another on the axle. Still further, the wheel components are formed of a material which is relatively soft and pliable, so that it has some "give" or compressibility when pressed against the skin surface.

Ideally, each of the wheel components is configured so that it is not round at its circumference or periphery; rather, each wheel component is configured so as to have at least five major faces—usually, six—around its periphery, where each face is gently concavely curved and the transition between adjacent faces is more prominently convexly curved. The wheels, and the materials from which they may be formed, are discussed in greater detail hereafter.

The present invention also recognizes that for such purposes as applying facial creams and lotions to the face and neck, it may be desirable that there be only a single axle having a few wheels mounted thereon; whereas for applying body lotions and especially reducing creams and the like, it may be desirable for there to be a plurality of axles that are mounted one behind another. Still further, in a preferred embodiment of a multi-axle lotion and cream applicator according to the present invention, a protrusion may be upstanding from the body portion of the applicator in which the multiple axles are mounted, so as to provide somewhat greater control by positioning the protrusion between adjacent fingers of the hand in which the applicator is held.

The prior art includes a device which has a plurality of wheels each having mushroom-shaped protrusions or pips that are formed of an injection moulded plastic that is quite rigid. A particular example of such an applicator is that which is the subject of an industrial design registration in the name of the present inventor, presently Canadian application No. 21-12-84-7. Other prior art devices include the following:

THOROGOOD et al, in WIPO Publication No. 8502984 published July 18, 1985, disclose an applicator for applying a depilatory compound which is relatively fluid in nature. That structure, however, requires and teaches only a single generally cylindrical roller which has an indented surface, and which is located in the mouth of a reservoir so as to be fed the depilatory composition from one side and to deposit it on the skin at the other side of the applicator head.

Another lotion applicator which is hand held is taught by KALES in U.S. Pat. No. 4,483,356 issued Nov. 20, 1984; but that applicator has a pad on a flexible bail inserted into a handle, so that the pad—which is flattened—may remain in uniform contact with the user's skin. The pad is associated with a flip-top cap which, when open and when the applicator is tilted downwardly, permits the lotion to drip onto the pad.

GAMACHE in U.S. Pat. No. 4,128,350 issued Dec. 5, 1978 also teaches an applicator which is associated with a cosmetic container. The applicator has a body member which has a metering channel, and a roller associated with it to pick up sun tan lotion or the like and spread it on the body.

One other body massager and/or cosmetic applicator is that taught in ZIMMER U.S. Pat. No. 3,542,016 issued Nov. 24, 1970, and it also uses a ball-type roller which is arranged in such a way that it may be in rolling engagement with the body and with the cosmetic or beauty cream to be applied. In this case, a plurality of ball-type rollers may be situated across a base member having a plurality of openings, one of each of which communicates with each ball roller.

The present invention, in contradistinction to any of the prior art, does not contemplate having a dispenser associated with the applicator; and more particularly, it does contemplate having a plurality of independently rotatable wheels or rollers, each of which has an indented or non-circular periphery, so that a lotion spreading and body massaging action can be achieved at the same time.

One embodiment of the present invention also contemplates a handle portion associated with a single axle on which a plurality of wheels according to the present invention are mounted, where the axle is retained between a pair of spring arms so that there is flexibility not only in the wheels themselves but also in the spring arms so as to provide greater adjustment of the cream applying and massaging pressure of the wheels against the body. This has been found to be of particular advantage when supplied in small sizes for use with facial creams and lotions, and in larger sizes for use with body lotions.

BRIEF DESCRIPTION OF THE DRAWINGS

The present invention will now be discussed in greater detail, in association with the accompanying drawings, in which.

DESCRIPTION OF THE PREFERRED EMBODIMENTS

As stated above, the present invention relates particularly to an applicator implement which is intended for massaging the body at the same time that a lotion or cream is spread over portions of the body. A typical multi-axle embodiment of an applicator according to the present invention is shown at 10 in FIG. 1; and a typical single axle embodiment of the present invention is shown at 12 in FIG. 6.

Figure 1:
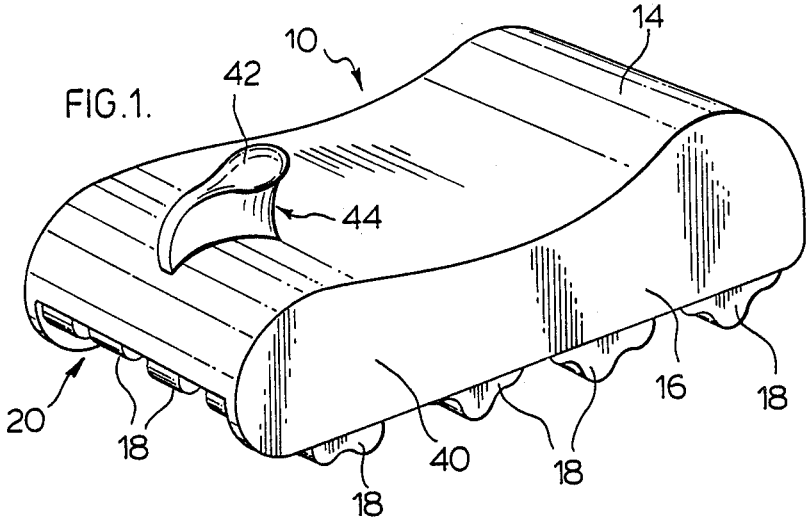
FIG. 1 is a perspective view of a typical multi-axle applicator according to the present invention.

Referring, first, to the applicator 10 of FIG. 1, it comprises a body portion 14 having two side pieces 16 (only one of which can be seen in FIG. 1) that are moulded integrally with the body. A plurality of wheel portions 18 is shown extending from below the body 14, and at the front end thereof. Each of the front and rear ends of the body 14 has a raised opening 20, so that the lower edges of the sides 16 are below the upper edges of the openings 20.

Figure 2:
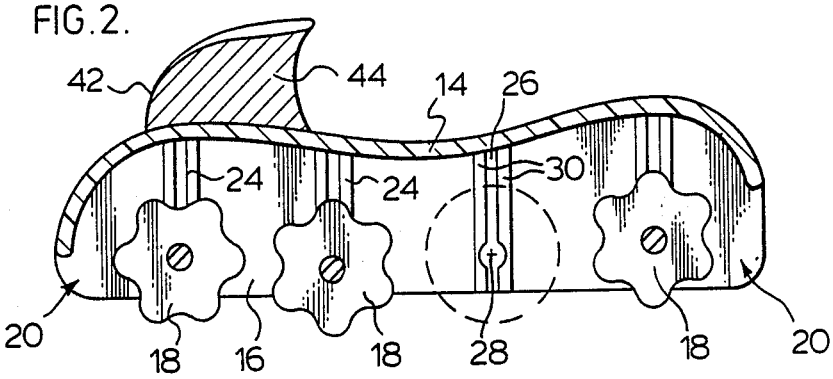
FIG. 2 is a cross section taken along the centre line of the structure of FIG. 1, with one of the axles having been removed for purposes of clarity.
Figure 3:
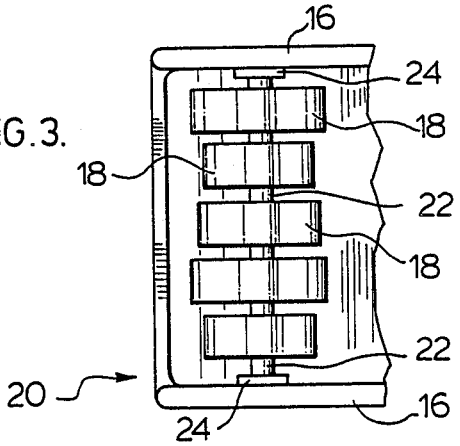
FIG. 3 is a bottom view looking at the front end of the structure of FIGS. 1 and 2.

Each of the wheel components 18 is mounted on an axle, such as that shown at 22 in FIG. 3. In the embodiment of FIGS. 1 to 3, there are four axles 22, and each is mounted across the width of the interior of the body 14 between rib members 24 that are formed with a vertical slot 26 therein. At the bottom of each vertical slot 26 there is an enlarged portion 28 which is generally circular, to accommodate the ends of the axles 22. Even though the material from which the body 14 and side pieces 16 is moulded may be substantially rigid—a suitable material being, for example, acrylonitrile-butadienestyrene (ABS) or other styrene polymers or copolymers, or also a hard high impact polyethylene or polypropylene, or co-polmyer thereof—there is sufficient flexibility in the upstanding edges 30 of the rib structures 24 that the axles 22 can be snapped into place and retained in the enlarged cavity portions 28 formed in the ribs 24. Other means of mounting the axles 22 may be devised, as appropriate.

It is not absolutely necessary that the axles 22 shall be, themselves, rotatable within the body 14 between the sides 16. What is important, however, is that each of the wheel components 18 is rotatable about the axle 22 on which it is mounted. Moreover, each of the wheel components 18 should be rotatable independently of any other wheel component 18 mounted on that same axle (or, of course, on any other axle).

Figure 4:
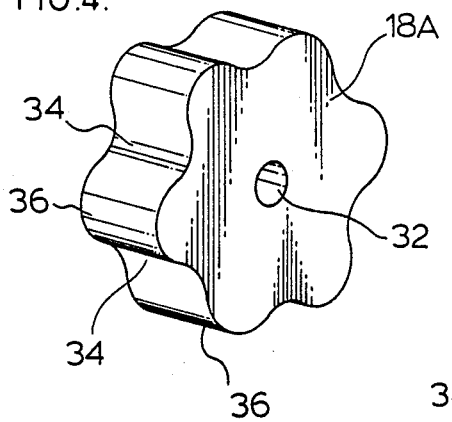
FIGS. 4 and 5 are different perspective views of two different embodiments of wheel component according to the present invention.
Figure 5:
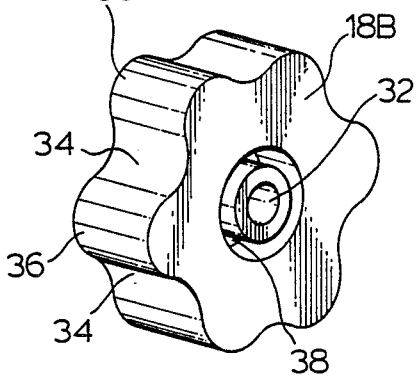

Referring now to FIGS. 4 and 5, preferred embodiments of wheel components 18A and 18B are shown. Each has a centrally located opening 32 which extends from one side of the wheel component to the other, so that it may be rotatably mounted on an axle 22. Usually, the diameter of the opening 32 is just slightly greater than the diameter of the axle 22 on which it is to be mounted.

It is a special feature of each of the wheel components 18 according to the present invention that its periphery is not circular, but rather that it is indented having at least five major faces around the periphery. The usual embodiment is six major surfaces, so as to be generally hexagonal; but at least five major surfaces are acquired so as to permit rotation which is effected by sliding interference between the respective wheels and the skin of the body portion of the user over which the wheel is being moved. Each of the major faces 34 is gently concavely curved, thereby providing the indentations referred to above; and each of the transition areas 36 between adjacent major faces 34 is convexly curved more prominently—i.e., with a much smaller radius of curvature—but not so as to create a sharp delineating line between adjacent major faces 34.

In the embodiment of wheel component 18B shown in FIG. 5, at least one circular groove 38 is formed in one of the side faces of the wheel, between the centre thereof and the periphery; usually, in such embodiment, a groove 38 is formed in each of the side faces of the wheel component (but of course it does not extend through the thickness of the wheel).

Each of the wheel components 18 is formed such as by injection moulding of a soft and pliable material. Such a material may be, for example, a soft polyethylene or even a self-skinned polyurethane or a soft polyurethane, or it may be a latex-based polymer or a thermoplastic rubber. One particularly useful elastomeric material that is relatively soft and pliable is a block co-polymer of the form A-B-A; where A is a polymerized mono-alpha-alkenyl arene, and B is a polymerized conjucated diene. One such material is sold in association with the trade mark KRATON as KRATON 3226/2000.

Obviously, depending on the softness and pliability of the material, the wheel components 18 may be moulded as a substantially solid component apart from the central openings such as shown by wheel component 18A in FIG. 4; or for additional pliability they may be moulded having a groove 38 such as wheel components 18B as shown in FIG. 5.

When a plurality of wheel components 18 is assembled on a plurality of axles 22, such as in the embodiment of FIGS. 1 to 3, it is obvious that if each of the wheel components 18 is rotatable independently of any of the other wheel components, there may at any time be differing contact of major faces of wheel component and transition points of the wheel components, with the skin of the user. Therefore, a massaging action occurs, stimulating the skin and subcutaneous tissues. At the same time, because there are a plurality of major faces 34 on the periphery of each of the wheel components 18, it is obvious that the cream or lotion which may have first been thickly spread or placed in a bead or puddle on the skin will be carried by the wheel components and deposited over the skin of the user where the applicator is being moved by the user. Moreover, by pressing more firmly or not so firmly, a higher or lower massaging stimulus may be effected, and the pressure against the body is more easily controlled because the pressure is first applied against the relatively rigid body 14 of the applicator and transferred through the axles 22 to the wheel components 18.

It is convenient that there be from three to five axles arranged in the multi-axle embodiment of the applicator according to the present invention, and that there be from four to eight wheel components 18 mounted on each of the axles.

It is also convenient that the side surfaces 16 of the applicator 10 be roughened or knurled in some way such as at 40, to provide a better grip for the fingers of the hand of the user when holding the applicator.

Moreover, a winged protrusion 42 having undercut portions 44 may be upstanding from the top surface of the body 14 near the front end thereof. Obviously, the neck of the protrusion 42 defined by the undercut portions 44 can be gripped between the fingers of the hand of the user, thereby effecting some measure of greater control and direction of motion of the applicator.

Figure 6:
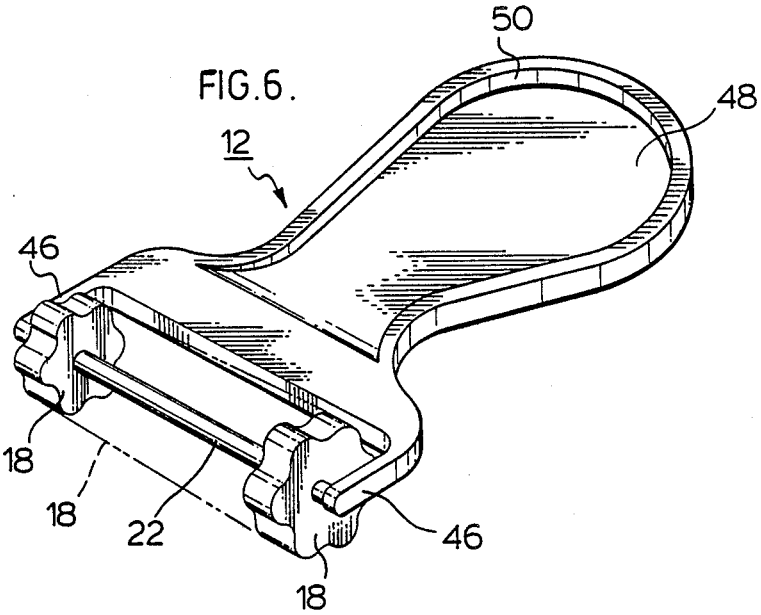
FIG. 6 is a perspective view of a single axle embodiment of the present invention.

In a further embodiment of the applicator of the present invention, as shown in FIG. 6, a single axle 22 is provided between side arms 46, where those side arms 46 are associated with a handle 48. The plane of the handle 48, the side arms 46 and the axle 22 are all the same, so that apart from the wheel components 18 the applicator 12 of FIG. 6 is substantially flat. Of course, for strength, a bead 50 may be formed around the outer edge of the handle 48.

It is also particularly convenient that the side arms 46 of the applicator 12 comprise spring arms which are flexible in a front to back sense with respect to the plane of the handle 48. Thus, relatively high pressure can be applied against the handle 48 by the hand of the user, and the pliability of the wheel components 18 together with the springiness of the spring arms 46, accommodates irregularities of surface as the applicator is being moved over the body. As mentioned, that structure when relatively small in size is particularly useful for application of facial creams and lotions, and in larger size for application of body lotions.

Thus, there has been described several differing embodiments of an applicator implement for massaging the body and for applying lotions or creams to the body. Those embodiments comtemplate a multi-axle embodiment and a single axle embodiment, where in any event a plurality of independently rotatable wheel components are mounted for rotation on the axles, and each wheel component has a plurality of major faces that are gently concavely curved, around its periphery. The applicator is particularly useful for such purposes as applying and spreading reducing creams and body lotions to the body, facial creams to the face, or other lotions and creams, while at the same time effecting a massaging action to the body portion over which the lotion or cream is being spread and applied. The applicator implements of the present invention are particularly useful in such instances when reducing creams are being applied to the body so as to reduce cellulite deposit or water retention in body tissues; but in all events, effective cream or lotion application to the body is effected while providing a massaging stimulus to the skin and subcutaneous tissue. The scope of the present invention is defined by the appended claims.

I claim:

1. An applicator implement for massaging the body and for spreading lotion or cream over portions of the body, comprising:

at least one axle mounted between side pieces at each end of said at least one axle;

body means connecting said side pieces so as to maintain said side pieces in fixed spaced relation one to the other;

a plurality of discrete wheel components mounted on said axle for rotation thereabout, where each of said wheel components is rotatable about said axle independently of any other wheel components mounted on said axle;

where each of said wheel components is formed of a soft and pliable material so as to be resilient when pressed against the body;

where each of said wheel components comprises at least five major faces around its periphery, where each major face is gently concavely curved and the transition between adjacent major faces is more prominently convexly curved;

where each of said wheels is of substantially constent thickness from side to side at least at the periphery, whereby, in use, displacement of the implement over a body portion of a user in wheel component rotating relation therewith results in independent radial variation of indentation at the area of contact of each individual contacting wheel component;

and where each of said wheels is formed with at least one circular groove formed in one of the side faces thereof, between the centre and the periphery of said wheel;

whereby, additional pliability of the wheel is achieved.

2. The applicator implement of claim 1, where each of said wheel components comprises six major faces.

3. The applicator implement of claim 2, where a groove is formed in each side face of each of said wheels.

4. The applicator implement of claim 2, where said body means has front and rear ends, and said side pieces extend between said front and rear ends; and where there are at least two axles arranged substantially parallel to one another between said side pieces, and each of said axles has a plurality of wheels mounted thereon.

5. The applicator implement of claim 4, where said body means is arranged with from three to five axles, and each of said axles has from four to eight wheels mounted thereon.

6. The applicator implement of claim 5, where each of said side pieces has a roughened outer surface for gripping by the fingers of the hand of a user.

7. The applicator implement of claim 5, where a winged protrusion is upstanding from the body portion at the top thereof and near the front end thereof.

8. The applicator implement of claim 2, where a single axle is arranged with said side pieces, and said body means is associated with a handle which is substantially in the same plane as said axle;

and where said side pieces comprise spring arms which are flexible in a front to back sense with respect to the plane of said handle, whereby, in use, greater adjustment of the cream applying and massaging pressure is facilitated.

* * * * *